United States Patent [19]

Foshee

[11] Patent Number: 4,873,853

[45] Date of Patent: Oct. 17, 1989

[54] ESCUTCHEON ASSEMBLY

[75] Inventor: William R. Foshee, Noblesville, Ind.

[73] Assignee: Best Lock Corporation, Indianapolis, Ind.

[21] Appl. No.: 328,105

[22] Filed: Mar. 23, 1989

[51] Int. Cl.[4] ..... E05B 15/02

[52] U.S. Cl. ..... 70/452

[58] Field of Search ..... 70/452, 381, 451, 370, 70/371

[56] References Cited

U.S. PATENT DOCUMENTS 1,512,368 10/1924 Shaw ..... 70/452

1,942,525 1/1934 Weller ..... 70/452

3,452,564 7/1969 Hallgren ..... 70/452

4,294,093 10/1981 Best ..... 70/452

*Primary Examiner*—Robert L. Wolfe

*Attorney, Agent, or Firm*—Barnes & Thornburg

[57] ABSTRACT

An escutcheon is provided for shielding a portion of a door panel or the like. The escutcheon includes a cover plate having outer and inner faces. The cover plate is formed to include an axially extending lock cylinder-receiving cavity having an annular rear opening in the inner face and a figure-8-shaped front opening in the outer face. A lock cylinder can be mounted in the cavity to display a figure-8-shaped front face of an interchangeable lock core housed in the lock cylinder through the figure-8-shaped front opening in the cover plate.

6 Claims, 1 Drawing Sheet

ESCUTCHEON ASSEMBLY

BACKGROUND AND SUMMARY OF THE INVENTION

This invention relates to escutcheons and, in particular, to escutcheons configured to receive lock cylinders of the type having interchangeable lock cores of figure-8 cross section.

It is well known to mount protective and ornamental cover plates or escutcheons on an exterior surface of a door at the point where the door handle projects outwardly from the door. Typically, escutcheons are formed to include openings for any or all of the controlling members of a mortise lock or bored lock such as the knob, lever handle, cylinder, or keyhole. For example, U.S. Pat. Nos. 4,589,691 and 4,389,061 disclose escutcheons configured for use with mortise locks.

One object of the present invention is to provide an escutcheon suitable for use with a lock cylinder having an interchangeable core of figure-8-shaped cross section.

Another object of the present invention is to provide an escutcheon configured to support the keyholed end of a lock cylinder in a recessed position therein so that only the figure-8-shaped front face of an interchangeable lock core at the keyholed end of the lock cylinder is visible to the casual observer once the escutcheon is mounted on a door.

Still another object of the present invention is to provide an escutcheon having a figure-8-shaped opening therein aligned with a lock core of figure-8-shaped cross section disposed in a lock cylinder mounted in the escutcheon so that only the figure-8-shaped front face of the lock core, which usually has a rotatable keyholed core plug in its lower lobe, is visible to the casual observer once the escutcheon is mounted on a door while exterior portions of the lock cylinder itself are hidden from view by the escutcheon.

According to the present invention, an escutcheon is provided for shielding a portion of a door panel or the like, the escutcheon includes a cover plate having outer and inner faces. The cover plate is formed to include an axially extending lock cylinder-receiving cavity having an annular rear opening in the inner face and a figure-8-shaped front opening in the outer face.

In preferred embodiments, the escutcheon further includes means on the inner face of the cover plate for attaching the cover plate to a door panel. The attaching means includes a first bolt assembly near the top of the inner face cover plate and a second bolt assembly near the bottom of the inner face of the cover plate. When the cover plate is attached to a door, the annular rear opening will face toward the door to receive a lock cylinder therein, and the figure-8-shaped front opening will face away from the door to provide an open, figure-8-shaped "window" for displaying the figure-8-shaped front face of an interchangeable lock core contained in the lock cylinder.

Interior surfaces of the cover plate define the configuration of the lock cylinder-receiving cavity in such a way as to support the lock cylinder therein so that the figure-8-shaped front face of an interchangeable core in a lock cylinder is positioned properly for display and access through the figure-8-shaped front window opening in the cover plate. Desirably, the cover plate includes a continuous, radially inwardly facing surface configured to define an annular side wall of the elongated lock cylinder-receiving cavity for surrounding a lock cylinder received therein. The cover plate also includes a radially inwardly extending, rearwardly facing surface configured to define a bottom wall of the elongated lock cylinder-receiving cavity.

The bottom wall of the cavity is provided to block forward movement of a lock cylinder inserted into the cavity. Further, the bottom wall of the cavity is formed to include the figure-8-shaped front opening extending through the cover plate so that the figure-8-shaped front opening of the lock core is displayed and the keyway provided in the lock core housed in the lock cylinder can be accessed through the open window provided by the figure-8-shaped front opening.

The open, figure-8-shaped window in the escutcheon of the present invention presents an attractive appearance in that its border frames the figure-8-shaped front face of the recessed, interchangeable lock core contained in the lock cylinder connected to the escutcheon. The sleek appearance of the escutcheon is a result of the fact that neither the lock core nor its cylinder protrude outwardly from the outer face of the escutcheon. At the same time, any decoration or trademark on the upper lobe of the interchangeable lock core's front face is visible to the casual observer through the figure-8-shaped lock core window.

Further, an interchangeable lock core of figure-8 cross section is easily removable from its parent lock cylinder through the front opening of the figure-8-shaped lock core window without removing the escutcheon from its door-mounted position. A conventional control key can be inserted into the core through the window and rotated relative to the lock cylinder to its core-releasing position without removing or otherwise disrupting the door-mounted escutcheon.

Additional objects, features, and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 8:
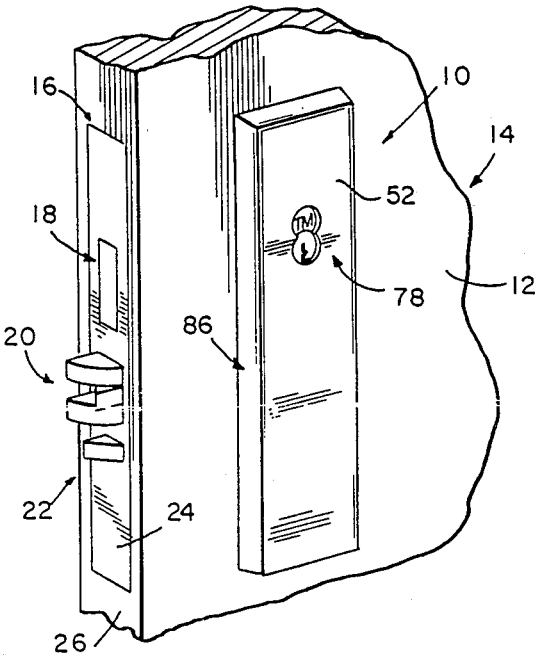
FIG. 8 is a perspective view of another embodiment of the present invention.

The escutcheon of the present invention is configured to hide substantially all of a lock cylinder from view upon installation of the escutcheon on a door except the figure-8-shaped front face of an interchangeable lock core contained in a lock cylinder connected to the escutcheon. Advantageously, such a configuration presents a sleek, attractive appearance without obstructing removal of the interchangeable lock core from its parent lock cylinder.

Figure 1:
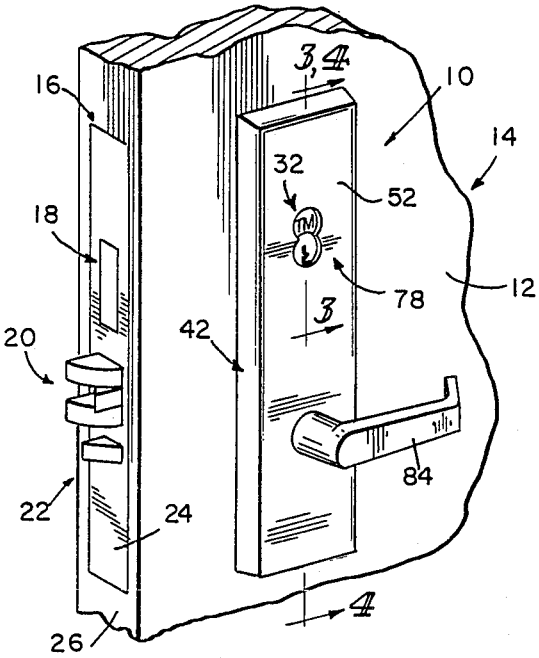
FIG. 1 is a perspective view of a first embodiment of the present invention mounted on a door.

Referring to FIG. 1, an escutcheon assembly 10 is mounted on a front face 12 of door 14. A mortise lock case 16 containing a deadbolt 18, latch bolt 20, and auxiliary bolt 22 is positioned in door 14 in the usual way. The mortise lock case 16 is arranged so that its armored front edge face 24 is positioned in the edge 26 of door 14. It will be appreciated that the use of escutcheon 10 is not limited to mortise lock environments, but rather is suitable for use in any situation calling for an escutcheon.

Figure 2:
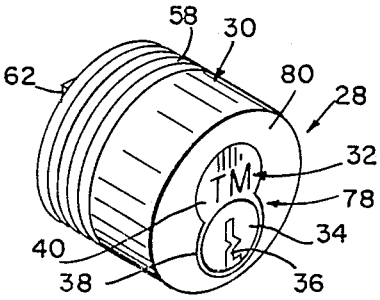
FIG. 2 is a perspective view of a lock cylinder containing an interchangeable lock core of figure-8 cross section showing the figure-8-shaped front face of the core wherein a trademark symbol is provided on the upper lobe and a key plug is rotatably disposed in the lower lobe.

A lock cylinder 28 of the type best suited for use with escutcheon 10 is illustrated in FIG. 2. Lock cylinder 28 includes a hollow lock body 30 configured to receive an interchangeable lock core 32 of figure-8 cross section therein. A key plug 34 providing key slot 36 is rotatably disposed in the lower lobe 38 of lock core 32 in the customary way. Typically, a trademark symbol or other design is provided on the upper lobe 40 of lock core 32 as shown in FIG. 2.

Figure 3:
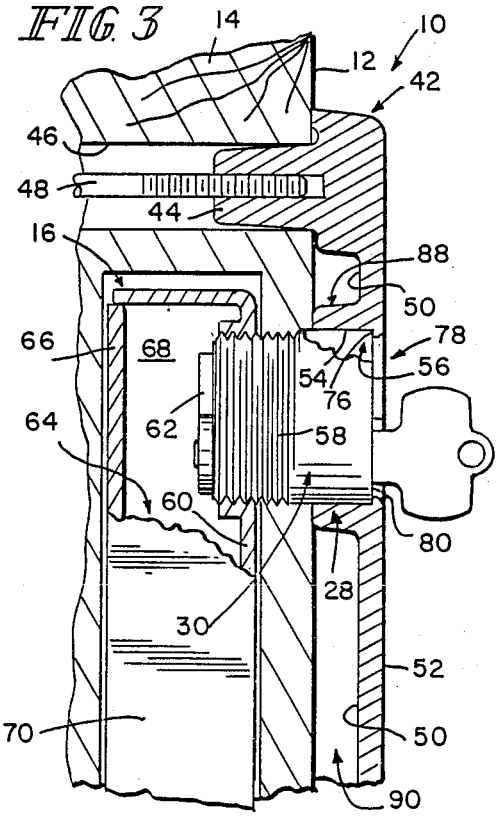
FIG. 3 is an enlarged cross-sectional view taken along lines 3—3 of FIG. 1 showing an escutcheon mounted on a door and bearing a lock cylinder connected to a mortise lock assembly mounted in the door.
Figure 4:
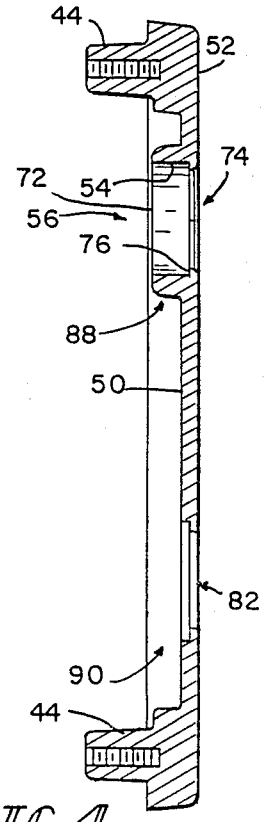
FIG. 4 is an enlarged cross-sectional view taken along lines 4—4 of FIG. 1 showing an unmounted escutcheon without a lock cylinder or lever handle mounted therein.

As shown in FIGS. 3 and 4, escutcheon 10 includes a cover plate 42 and a pair of mounting posts 44 for attaching cover plate 42 to door 14. A mounting post 44 is provided at each end of cover plate 42 and is insertable into one of the mounting holes 46 formed in the door. Each mounting post 44 is connectable to a bolt 48 or the like to hold cover plate 42 in its place on front face 12 of door 14.

Cover plate 42 includes an inner face 50 presented toward the front face 12 of door 14 and an outer face 52 as best seen in FIG. 3. Cover plate 42 includes a longitudinally extending, radially inwardly facing cylindrical wall 54 which defines a lock cylinder-receiving cavity 56 configured to hold lock cylinder 28 therein in a mortise lock-operating orientation as shown in FIG. 3. The inner end 58 of lock body 30 is threaded to engage the front wall 60 of mortise lock case 16 and positioned inside case 16 so that an operating cam 62 on inner end 58 is pivotable about its axis of rotation to engage and actuate a conventional mortise lock mechanism 64 mounted inside the case 16. Mortise lock case 16 also includes back wall 66 situated in spaced-apart parallel relation to front wall 60 and side edge walls 68, 70 extending therebetween.

Figure 5:
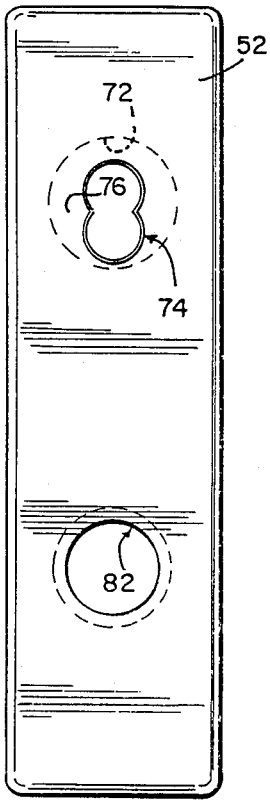
FIG. 5 is a front plan view of the escutcheon illustrated in FIGS. 1, 3, and 4 showing the outer face and the figure-8-shaped window opening therein.

Referring to FIGS. 4 and 5, it will be seen that cover plate 42 is formed to include an annular rear opening 72 into cylinder-receiving cavity 56 in inner face 50 and a figure-8-shaped front opening or aperture 74 into cylinder-receiving cavity 56 in outer face 52. The annular rear opening 72 is sized to admit lock cylinder 28 into cavity 56 and the figure-8-shaped front aperture 74 is sized to match the shape of the figure-8-shaped front face 78 of interchangeable lock core 32 as shown best in FIG. 1.

Figure 6:
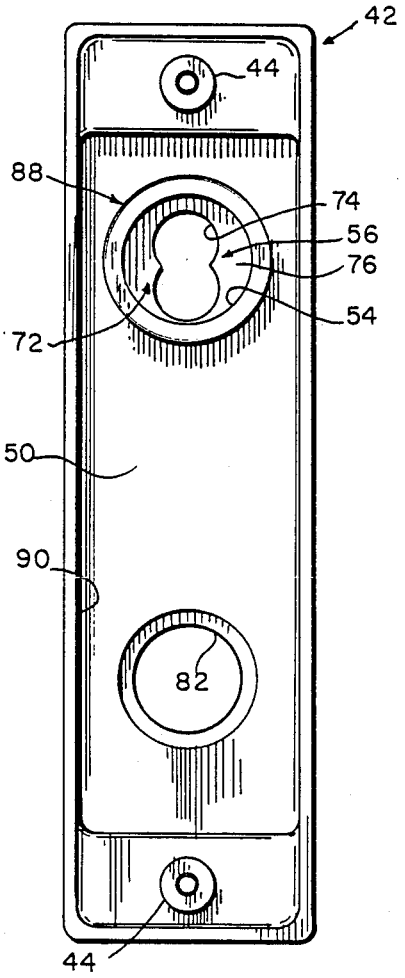
FIG. 6 is a rear plan view of the escutcheon illustrated in FIGS. 1 and 3–5 showing both of the annular rear opening and figure-8-shaped front opening of the lock cylinder-receiving cavity as well as the bottom wall of the cavity forming the figure-8-shaped front opening.

A radially inwardly extending, rearwardly facing, flat surface 76 on inner wall 50 forms a bottom wall in lock cylinder-receiving cavity 56 and also includes the rearwardly facing opening of the figure-8-shaped front aperture 74 as shown best in FIG. 6. Essentially, bottom wall 76 provides a rearwardly facing lip inside cavity 56 which is presented toward the annular rear opening 72 to engage a front wall 80 of lock body 30 so that the figure-8-shaped front face 78 of lock body 30 is aligned with the figure-8-shaped front aperture 74 and visible therethrough to an observer looking at the outer face 52 of cover plate 42. As shown in FIG. 3, the exposed figure-8-shaped front face 78 of lock body 30 is recessed slightly within cover plate 42 to lie in spaced-apart parallel relation to the outer face 52 of cover plate 42 when the front wall 80 of lock body 30 abuts the bottom wall 76 of cylinder-receiving cavity 56.

The cover plate 42 in the embodiment of FIGS. 1, 3, 4, and 5 is also formed to include an aperture 82 for receiving the spindle assembly (not shown) used to support a lever handle 84. Of course, it will be understood that other apertures could also be formed in the cover plate 42 to mount turn knobs, push buttons, or the like without departing from the scope of the present invention. The single difference between the embodiment of FIGS. 1 and 8 is that cover plate 42 in the embodiment of FIG. 1 is formed to include handle-receiving aperture 82 whereas cover plate 86 in the embodiment of FIG. 8 does not include such an aperture.

Referring now to FIGS. 3, 4, and 6, it will be seen that cover plate 42 includes a rearwardly extending cylinder mounting fixture 88 appended to inner wall 50 in an interior region of a shallow cavity 90 which opens toward door 14. Mounting fixture 88 includes the cylindrical wall 54 configured to define the cylinder-receiving cavity 56.

Figure 7:
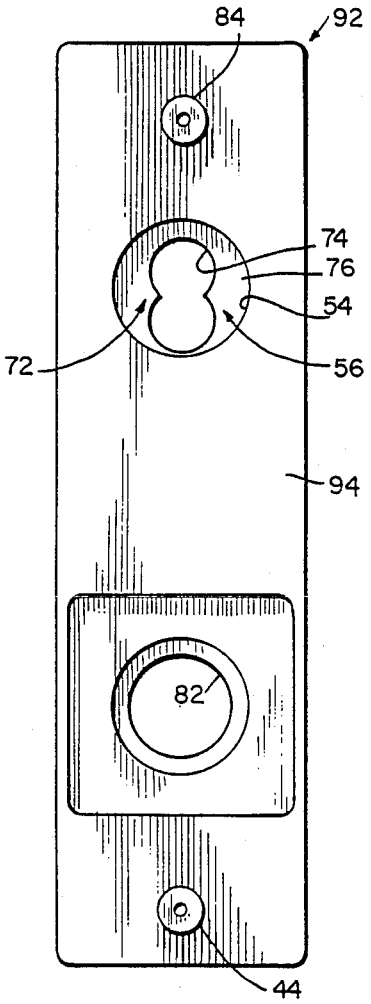
FIG. 7 is a view similar to FIG. 6 showing another embodiment of the present invention.

In another embodiment of the invention illustrated in FIG. 7, those elements referenced by numbers identical to those in FIGS. 1–6 perform the same or similar function. In the embodiment of FIG. 7, a cover plate 92 is shown to include a substantially flat inner face 94 formed to include the annular rear opening 72 for lock cylinder-receiving cavity 56.

In use, the interchangeable lock core 32 is easily removable from its home in the lock body 30 through the figure-8-shaped aperture 74 by using a conventional control key to release the lock core 32 in the normal way. Advantageously, the lock core 32 has a figure-8-shaped cross section matching the shape of aperture 74 so that the core 32 can be easily pulled from the lock body 30 without removal or disruption of the mounted cover plate 42.

The cover plate 42 is configured to hold the forwardmost portion of lock cylinder 28 in a slightly recessed position therein to provide a sleek, streamlined escutcheon. The attractiveness of the escutcheon is enhanced by hiding from view substantially all portions of lock cylinder 28 except for the figure-8-shaped front face 78 of the lock core. Such a feature exposes any trademark or design on the upper lobe 40 of face 78 to visual inspection and also permits easy access to the keyway 36 in the core plug 34 of the lower lobe 38.

Although the invention has been described in detail with reference to certain preferred embodiments, variations, and modifications exist within the scope and spirit of the invention as described and defined in the following claims.

What is claimed is:

1. An escutcheon for shielding a portion of a door panel or the like, the escutcheon comprising a cover plate having outer and inner faces, the cover plate being formed to include an elongated lock cylinder-receiving cavity having an annular rear opening in the inner face and a figure-8-shaped front opening in the outer face.

2. The escutcheon of claim 1, further comprising means on the inner face of the cover plate for attaching the cover plate to a door panel.

3. The escutcheon of claim 1, wherein the cover plate includes a radially inwardly facing, annular surface configured to define a side wall of the elongated lock cylinder-receiving cavity and a radially inwardly extending, rearwardly facing surface configured to define a bottom wall of the elongated lock cylinder-receiving cavity, and the radially inwardly extending, rearwardly facing surface is formed to include the figure-8-shaped opening to expose only the figure-8-shaped front face of a lock core contained in a lock cylinder positioned in the lock cylinder-receiving cavity to engage the bottom wall thereof to visual inspection upon mounting the inner face of the cover plate against a door panel or the like.

4. The escutcheon of claim 1, further comprising a lock cylinder disposed in the lock cylinder-receiving cavity, the lock cylinder including a lock core therein having a figure-8-shaped front face presented toward the figure-8-shaped front opening in the outer face, the figure-8-shaped front opening being defined by a figure-8-shaped border edge connected to the outer face of the cover plate and sized to enframe the figure-8-shaped front face of the lock core so that the front face of the lock core is recessed a predetermined distance in relation to the outer face of the cover plate.

5. An escutcheon for shielding a portion of a door panel or the like, the escutcheon comprising a cover plate having inner and outer faces, a lock cylinder-mounting fixture depending from the inner face of the cover plate, the lock cylinder-mounting fixture including a side wall cooperating with a selected portion of the inner face of the cover plate to define a lock cylinder-receiving cavity, the cover plate being formed to include an inner edge of figure-8 shape defining an aperture extending between the outer face and the selected portion of the inner face to provide a figure-8-shaped opening in the cover plate aligned with the lock cylinder-mounting fixture to expose only the figure-8-shaped front face of a lock core contained in a lock cylinder positioned in the lock cylinder-receiving cavity to engage the selected portion of the inner face of the cover plate to visual inspection upon mounting the inner face of the cover plate against a door panel or the like.

6. An escutcheon for shielding a portion of a door panel or the like, the escutcheon comprising a cover plate formed to include a lock core aperture therethrough of figure-8 cross section, the cover plate including an outer face formed to include a figure-8-shaped opening communicating with the lock core aperture and an inner face including means for attaching the cover plate to a door panel, the cover plate being formed to include an annular inner side wall defining a cylindrical lock cylinder-receiving cavity having an inlet opening in the inner face and an outlet opening connected to the lock core aperture and an inner lip presented toward the inlet opening and situated at the interface between the cylindrical lock cylinder-receiving cavity and the figure-8-shaped lock core aperture so that a figure-8-shaped front face of a lock core contained in a lock cylinder positioned in the lock cylinder-receiving cavity to engage the inner lip is aligned with the lock core aperture and visible through the figure-8-shaped opening in the outer face upon attaching the inner face of the cover plate to the door panel.

* * * * *